US006053316A

United States Patent [19]

Lo

[11] Patent Number: 6,053,316

[45] Date of Patent: Apr. 25, 2000

[54] TOOL BOX COMBINATION

[76] Inventor: Lai Sung Lo, No. 45, Lane 244, Tung Hwa North Road, Taipei, Taiwan

[21] Appl. No.: 09/267,937

[22] Filed: Mar. 11, 1999

[51] Int. Cl.[7] ..... B65D 85/20; A47F 7/00

[52] U.S. Cl. ..... 206/379; 211/69; 220/23.4

[58] Field of Search ..... 206/379, 372, 206/443, 374–378; 220/23.4, 23.8; 211/70.6, 69, 70, 199

[56] References Cited

U.S. PATENT DOCUMENTS

| | | | |
|---|---|---|---|
| D. 153,069 | 3/1949 | Linneman | D3/295 |
| 969,228 | 9/1910 | Wells | 211/69 |
| 1,018,729 | 2/1912 | Sine | 211/69 |
| 1,357,041 | 10/1920 | Fritch | 211/69 |
| 2,305,021 | 12/1942 | Meier | 206/379 |
| 2,568,089 | 9/1951 | Pendleton | 211/69 |
| 2,589,234 | 3/1952 | Drohman | 206/379 |
| 3,904,035 | 9/1975 | Metzler et al. | 206/379 |
| 4,030,599 | 6/1977 | Bruni | 206/379 |
| 5,535,882 | 7/1996 | Liu | 206/377 |
| 5,839,580 | 11/1998 | Budert | 206/379 |

*Primary Examiner*—Bryon P. Gehman
*Attorney, Agent, or Firm*—Charles E. Baxley, Esq.

[57] ABSTRACT

A tool box includes a housing having one or more orifices for receiving tool members. One or more casings are attached to the housing and each has one or more punctures for receiving the tool members. A cap has one end pivotally coupled to the housing and has the other end engaged with the housing and the casings to secure the housing and the casings together. The housing includes a curved bar and the casing includes a curved slot for receiving the bar and for securing the casing to the housing. The cap includes a latch engaged with the housing and the casings.

5 Claims, 4 Drawing Sheets

TOOL BOX COMBINATION

BACKGROUND OF THE INVENTION

1. Field of the Invention

The present invention relates to a tool box, and more particularly to a tool box combination having two members secured together by a cap.

2. Description of the Prior Art

Typical tool boxes comprise a housing having one or more chambers formed therein for receiving the tool members, such as the tool bits and the driving tools, which are randomly received in the tool boxes and which may not be easily obtained and selected by the user.

The present invention has arisen to mitigate and/or obviate the afore-described disadvantages of the conventional tool boxes.

SUMMARY OF THE INVENTION

The primary objective of the present invention is to provide a tool box combination including two or more members secured together by a cap for receiving the tool members in series or for organizing the tool members.

In accordance with one aspect of the invention, there is provided a tool box combination comprising a housing including an upper portion having at least one orifice formed therein for receiving a tool member, and including a rear portion and a front portion and including a side portion, at least one casing including an upper portion having at least one puncture formed therein for receiving the tool member, and including a front portion, means for attaching the casing to the side portion of the housing, and a cap including a first end pivotally coupled to the rear portion of the housing at a pivot pin and including a second end engaged with the housing and the casing to secure the housing and the casing together.

The rear portion of the housing includes a hub, the rear portion of the cap includes at least one ear formed thereon, the pivot pin is engaged through the hub of the housing and the ear of the cap for pivotally coupling the cap to the housing.

The second end of the cap includes a latch engaged with the housing and the casing to secure the housing and the casing together. The front portions of the housing and the casing each includes a cavity formed therein, the latch includes a projection engaged with the cavities of the housing and the casing to secure the housing and the casing together.

The housing includes a bar, the casing includes a slot formed therein for slidably receiving the bar and for allowing the casing to be secured to the housing. The bar and the slot of the casing are curved and each includes an L-shape cross section.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
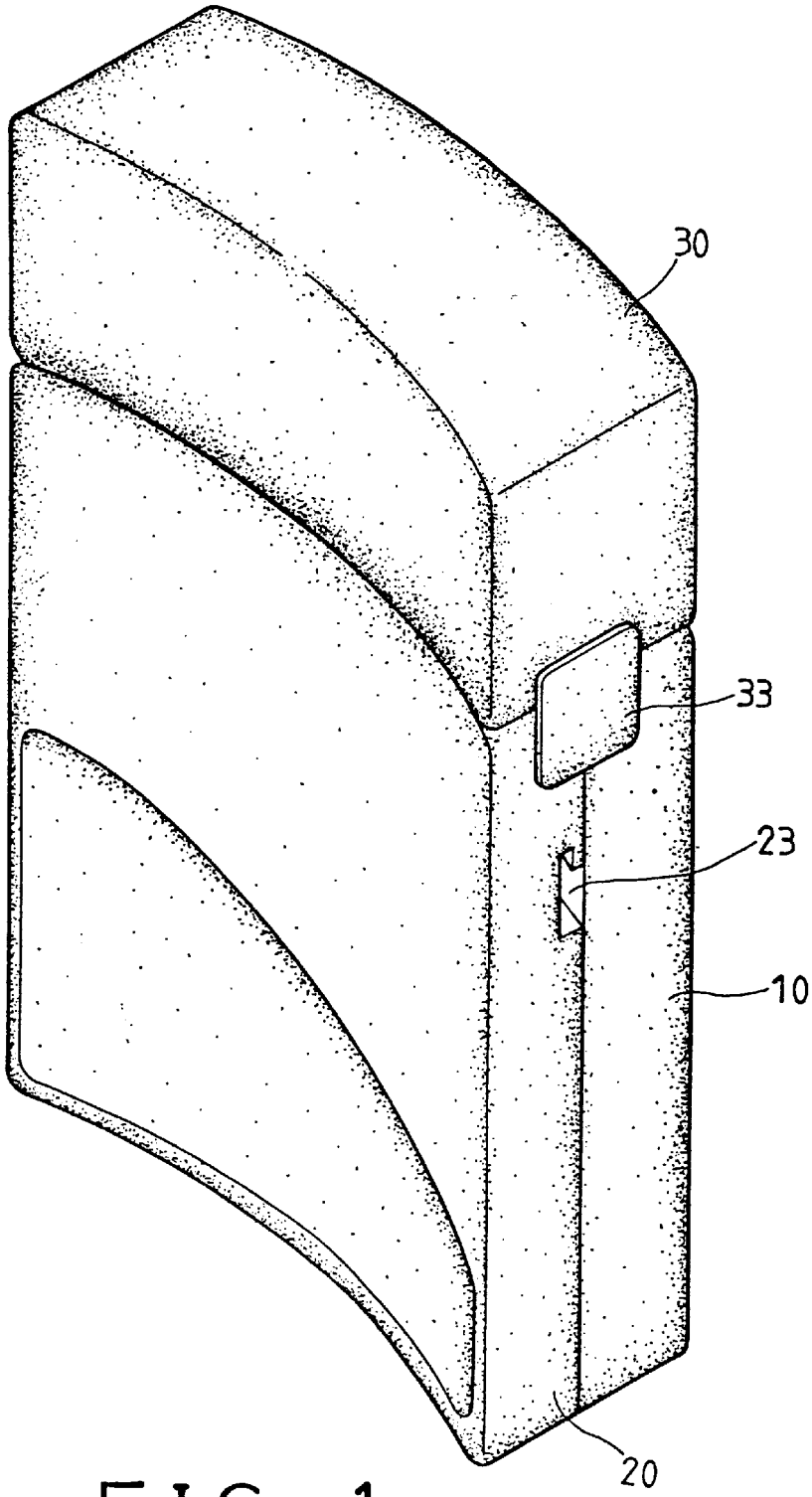
FIG. 1 is a perspective view of a tool box combination in accordance with the present invention.
Figure 2:
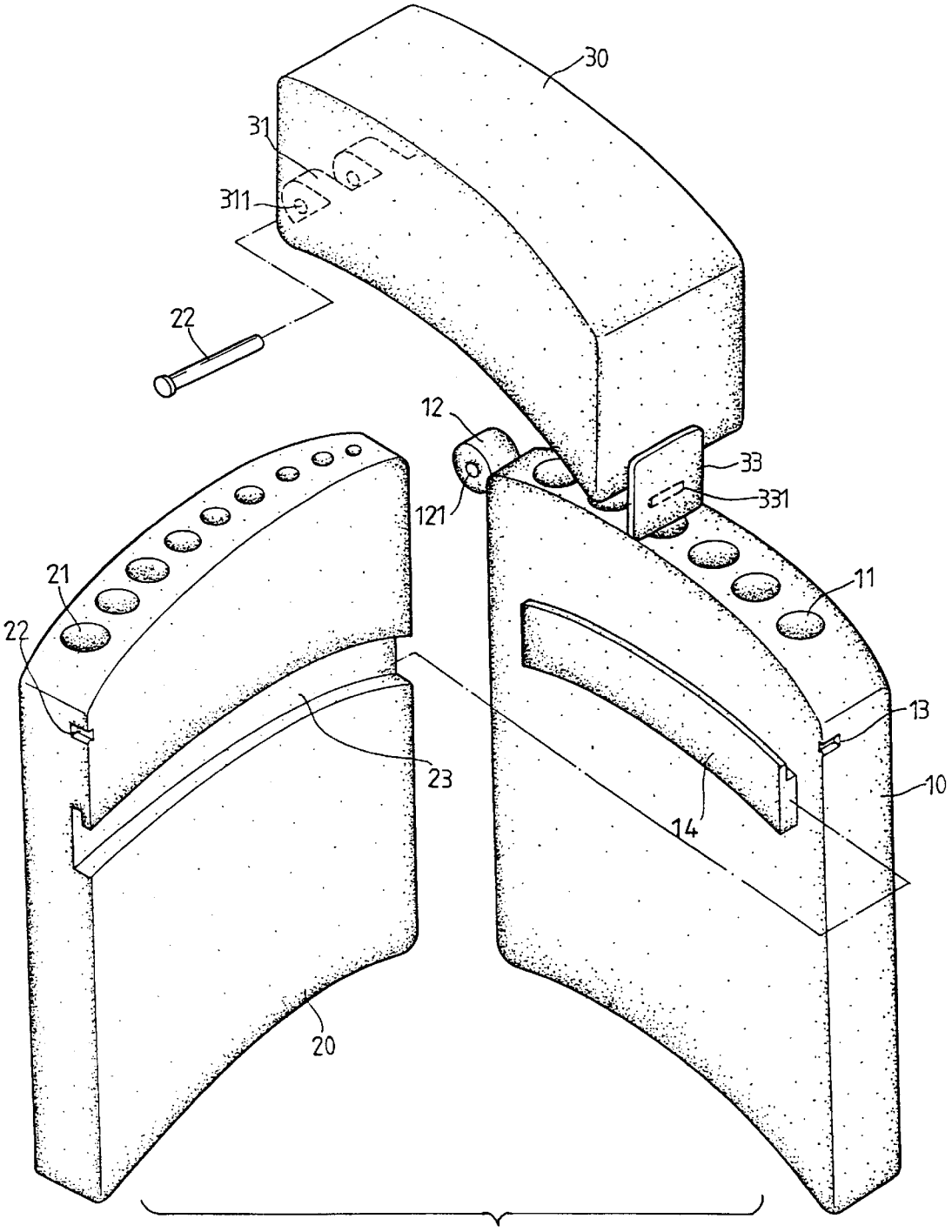
FIG. 2 is an exploded view of the tool box combination.

Referring to the drawings, and initially to FIGS. 1 and 2, a tool box combination in accordance with the present invention comprises a housing 10 including a number of orifices 11 formed in the upper portion thereof for receiving tool bits 40 (FIG. 4), for example, and including a rear portion having a hub 12 and having an aperture 121 formed in the hub 12 for receiving a pin 22. The housing 10 includes a side portion having a curved bar 14 extended therefrom. A casing 20 includes a curved slot 23 formed in the side portion for receiving the bar 14 of the housing 10 and for allowing the casing 20 to be attached to the housing 10. The casing 20 includes a number of deeper punctures 21 (FIG. 4) formed in the upper portion for receiving the tool members, such as the drilling tool bits. The housing 10 and the casing 20 each includes a front portion having a cavity 13, 22 formed therein.

A cap 30 includes one or more ears 31 extended from the rear portion thereof and having a hole 311 for receiving the pin 22 and for allowing the cap 30 to be pivotally secured to the housing 10 at the pin 22. The cap 30 includes a latch 33 provided in the front portion thereof and having a projection 331 for engaging into the cavities 13, 22 of the housing 10 and the casing 20 and for securing the casing 20 to the housing 10. It is to be noted that the sliding engagement of the bar 14 of the housing 10 with the slot 23 of the casing 20 limits that casing 20 to move forward and rearward relative to the housing 10 and prevents the casing 20 from moving up and down relative to the housing 10. The engagement of the cap 30 with the housing 10 and the casing 20 may lock the casing 20 to the housing 10 and may prevent the casing 20 from moving relative to the housing 10.

Figure 3:
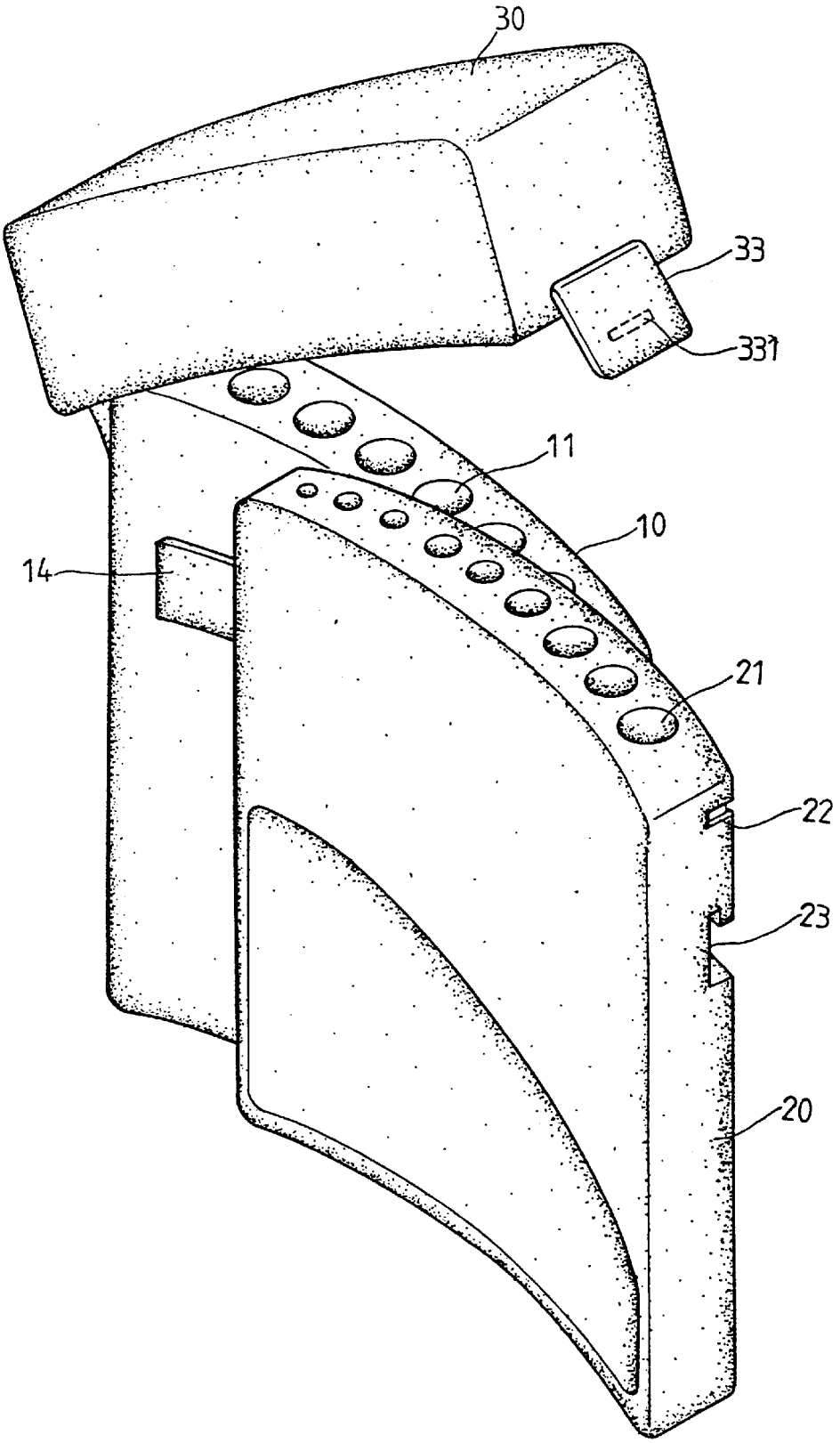
FIG. 3 is a perspective view illustrating the operation of the tool box.
Figure 4:
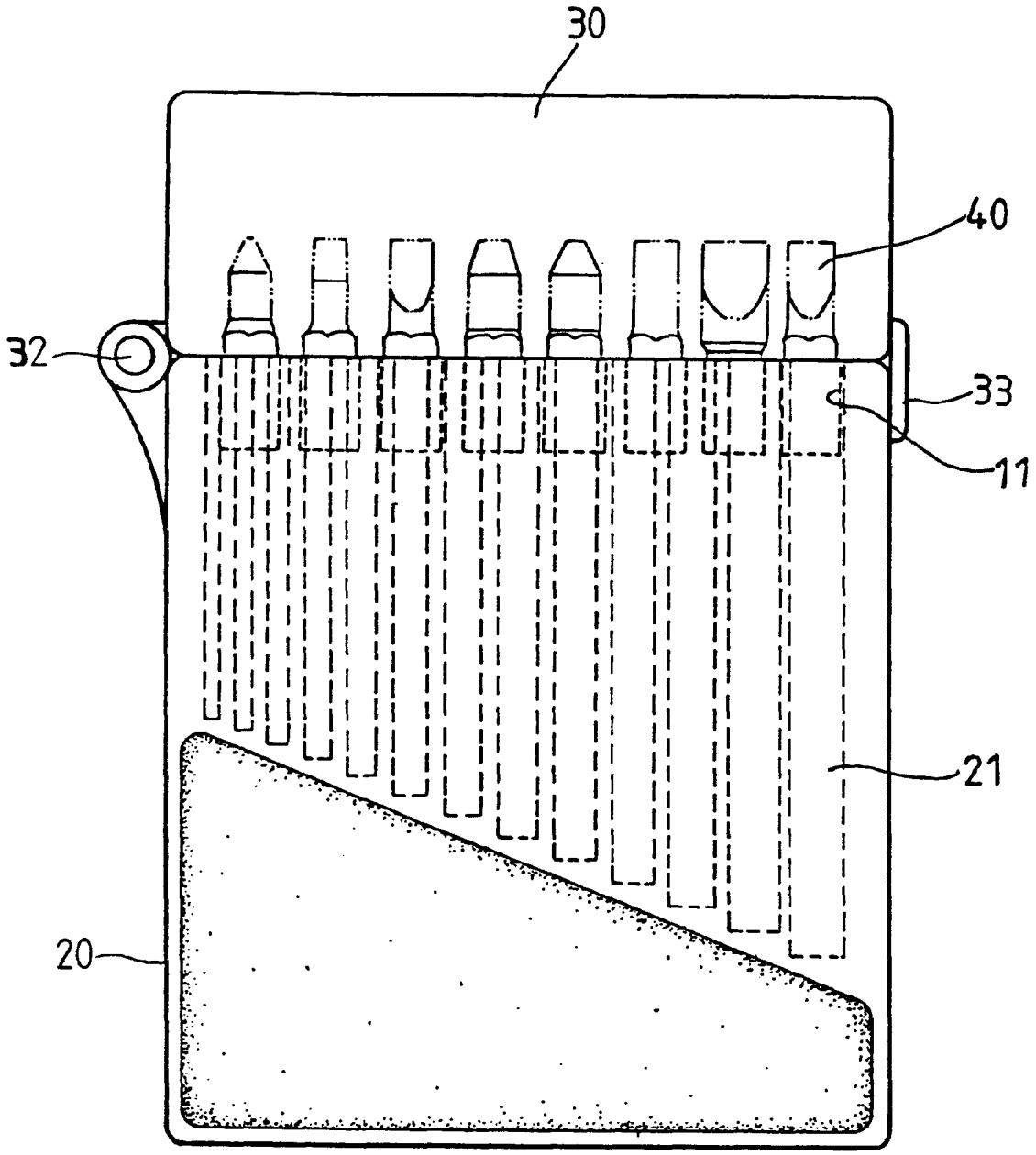
FIG. 4 is a plane view illustrating the application of the tool box combination.

Referring next to FIG. 3, when the cap 30 is disengaged from the casing 20 and when the casing 20 is moved forward or rearward relative to the housing 10, the tool members received and organized in the orifices 11 of the housing 10 and in the punctures 21 of the casing 20 may be easily obtained. When the cap 30 is engaged with the housing 10 and the casing 20, the tool members 40 may be stably retained in the housing 10 and the casing 20 (FIG. 4).

It is to be noted that the bar 14 and the slot 23 of the casing 20 are not necessarily be curved and may include a straight structure, and include corresponding mating cross section, such as the L-shaped cross section as shown in FIGS. 1–3, for allowing the casing 20 to be stably attached to the housing 10. The casing 20 may also include a bar 14 for allowing the other casings to be attached to the casing 20. The cap 30 may include a size large enough to engage with the casings 20 and the housing 10 together. Alternatively, the housing 10 may include a slot for receiving the bar of the casings 20.

Accordingly, the tool box combination in accordance with the present invention includes two or more members secured together by a cap for receiving the tool members in series or for organizing the tool members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box combination comprising:

a housing including an upper portion having at least one orifice formed therein for receiving a tool member, and including a rear portion and a front portion and including a side portion, at least one casing including an upper portion having at least one puncture formed therein for receiving a tool member, and including a front portion, means for attaching said at least one casing to said side portion of said housing, and a cap including a first end pivotally coupled to said rear portion of said housing at a pivot pin and including a second end engaged with said housing and said at least one casing to secure said housing and said at least one casing together, said second end of said cap including a latch engaged with said housing and said at least one casing to secure said housing and said at least one casing together, said front portions of said housing and said at least one casing each including a cavity formed therein, said latch including a projection engaged with said cavities of said housing and said at least one casing to secure said housing and said at least one casing together.

2. The tool box combination according to claim 1, wherein said rear portion of said housing includes a hub, said first end of said cap includes at least one ear formed thereon, said pivot pin is engaged through said hub of said housing and said at least one ear of said cap for pivotally coupling said cap to said housing.

3. The tool box combination according to claim 1, wherein said housing includes a bar, said at least one casing includes a slot formed therein for slidably receiving said bar and for allowing said at least one casing to be secured to said housing.

4. The tool box combination according to claim 3, wherein said bar and said slot of said at least one casing are curved.

5. The tool box combination according to claim 3, wherein said bar and said slot of said at least one casing each includes an L-shape cross section.

* * * * *